US007034459B2

(12) United States Patent
Lin et al.

(10) Patent No.: US 7,034,459 B2
(45) Date of Patent: Apr. 25, 2006

(54) FRONT PANEL STRUCTURE OF PLASMA DISPLAY PANEL

(75) Inventors: Chun-Hsu Lin, Taipei Hsien (TW); Hsu-Pin Kao, Ping Chen (TW); Ching-Hui Lin, Taoyuan (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 10/866,083

(22) Filed: Jun. 14, 2004 (Under 37 CFR 1.47)

(65) Prior Publication Data

US 2005/0017636 A1 Jan. 27, 2005

(30) Foreign Application Priority Data

Jun. 13, 2003 (TW) ..... 92116197 A

(51) Int. Cl.
*H01J 17/49* (2006.01)

(52) U.S. Cl. ..... 313/583; 313/584; 313/585

(58) Field of Classification Search ..... 313/581–586; 315/169.1, 169.4; 345/66–68, 204
See application file for complete search history.

(56) References Cited

U.S. PATENT DOCUMENTS 6,084,349 A * 7/2000 Ueoka et al. ..... 313/587
6,313,580 B1 * 11/2001 Makino ..... 313/582
6,498,594 B1 * 12/2002 Nunomura ..... 345/60
6,504,519 B1 * 1/2003 Ryu et al. ..... 345/60
6,794,819 B1 * 9/2004 Kao et al. ..... 313/582
2002/0084752 A1 * 7/2002 Yoshioka et al. ..... 313/584
2003/0015964 A1 * 1/2003 Park et al. ..... 313/585
2003/0209982 A1 * 11/2003 Kim et al. ..... 313/584

FOREIGN PATENT DOCUMENTS

JP 10-321142 12/1998

* cited by examiner

*Primary Examiner*—Joseph Williams
*Assistant Examiner*—Peter Macchiarolo
(74) *Attorney, Agent, or Firm*—Hoffman, Wasson & Gitler

(57) ABSTRACT

A front panel structure of Plasma Display Panel (PDP) is disclosed sequentially comprising a first electrode, a second electrode and a third electrode, wherein the second electrode has transparent electrodes located on both top and bottom sides of a bus electrode. A first discharge center is formed between a transparent electrode of the first electrode and one transparent electrode of the second electrode. A second discharge center is formed between the other transparent electrode of the second electrode and a transparent electrode of the third electrode. Therefore, an emitting cell of PDP has two discharge centers. To make the discharge more stable, we choose the first electrode and the third electrode to become the scan electrodes, or to form a thicker dielectric layer or discharge deactivation film below the second bus electrode as a scan electrode.

26 Claims, 9 Drawing Sheets

FRONT PANEL STRUCTURE OF PLASMA DISPLAY PANEL

FIELD OF THE INVENTION

The present invention relates to a plasma display panel (PDP), and more particularly, to a front panel structure of the PDP.

BACKGROUND OF THE INVENTION

Since multi-media are rapidly developed, the standard of users' requirements for peripheral audio and video devices is getting higher and higher. Because of the oversized volume, CRT(Cathode Ray Tube)-type display devices used to be popular can no longer meet the requirements in the current age of focusing on lightness, thinness, shortness and smallness. Hence, many technologies regarding flat panel displays have been developed subsequently, such as a liquid crystal display (LCD), a PDP and a field emission display (FED), which have been gradually become the mainstream of future display devices, wherein the PDP used as a full-color display device has received great attention due to its large display area, particularly for the application on big-sized TVs or outdoor bulletins. The reasons why the PDP is so popular are that: the PDP has the display capability of high image quality, which is resulted from the light-emitting style of wide view angle and the high-speed response. Further, the process for manufacturing the PDP is relatively simple and suitable for use in big-sized display devices.

In a color PDP, gas discharge is used to generate ultraviolet (LTV) ray to excite phosphors to emit visible light, thereby achieving the display effect. According the discharge mode of the PDP, the color PDP can be briefly divided into an AC type and a DC type. In an AC-typed PDP, there is a passivation layer covering an electrode, so that the AC-typed PDP has relatively long operation life and relatively high display brightness. Hence, with regard to the display effect, the luminance efficiency and the operation life, the AC-typed PDP is generally superior to a DC-typed PDP.

Generally, the structure of three electrodes is used in the AC-typed PDP, including a common electrode, a scan electrode and an address electrode. FIG. 1 is a schematic top view showing the front panel structure of a general PDP. Referring to FIG. 1, the front panel structure is mostly formed in a top substrate located on one side of the image display, including an electrode 10 and an electrode 12 which are opposite to each other in structure, wherein one of the electrodes is a scan electrode and the other is a common electrode. Both of the electrode 10 and the electrode 12 are composed of a transparent electrode 14 and a bus electrode 16, wherein the transparent electrode 14 is generally made of transparent electrode material, such as indium tin oxide (ITO; a mixture of indium oxide and tin oxide), used for allowing visible light to pass through. Also, in comparison with metal, the transparent electrode 14 has lower electrical conductivity, and thus the bus electrode 16 which is narrow and has excellent electrical conductivity has to be added to the transparent electrode 14, so as to increase the overall electrical conductivity, wherein the bus electrode 16 can be made of the material such as black silver or white silver.

An emitting cell 20 is a division formed by using separation walls 24 in the structure of bottom substrate, wherein the area enclosed by the separation walls 24 forms the emitting cell 20, such as the square area enclosed by dashed lines shown in FIG. 1. Further, the bus electrode 16 crosses over each of the emitting cells 20 arranged in a row, and is connected to a signal-supplying device (not shown), thereby controlling the gas discharge of a specific emitting cell. A discharge center 22 of each emitting center 20 is located between two transparent electrodes 14, such as the circular area enclosed by dashed lines shown in FIG. 1. In the area between the emitting cells 20 of different rows, a black-line structure 18 is generally formed for blocking the light therebelow.

When a voltage is applied to the specific cell, the potential between electrodes will form an electric field, thereby accelerating the charged particles of the gas mixture sealed in the emitting cell, and the charged particles also collide with neutral particles so as form more electrons and ions for generating vacuum ultraviolet (VUV) light. Then, the VUV light is used to excite phosphors existing in the emitting cell, so as to enable the phosphors of three colors, red (R); green (G); and blue (B), to generate visible light for further displaying an image.

SUMMARY OF THE INVENTION

In the structural design of the electrodes in the top substrate of the conventional PDP, each of the emitting cells has only one discharge center. Hence, when the PDP is performing a discharge step, the electric field intensity is the maximum at the central position in the emitting cell, and thus sever discharge occurs at the center of the emitting cell. Since the sever discharge is concentrated in the neighborhood of the discharge center, the conventional PDP has lower discharge efficiency and short operation life. Further, in the conventional front panel structure, the area of the transparent electrode is too large, thus causing overlarge peak current generated during discharge, so that not only the load of the circuit elements is increased, but also the production life and the operational voltage range of the panel are affected.

Hence, one object of the present invention is to provide a front panel structure of a PDP, each of the emitting cells having at least two discharge centers, used for providing relatively uniform discharge current and area.

Hence, the other object of the present invention is to provide a PDP applied to the aforementioned front panel structure of dual discharge centers, for improving the operation life of the panel.

According the objects of the present invention, a front panel structure of the present invention comprises: a first electrode; a third electrode and a second electrode located between the first electrode and the third electrode, wherein the first electrode is composed of a bus electrode and a transparent electrode located on one side of the bus electrode; the second electrode is composed of a bus electrode and two transparent electrodes located on the top and bottom sides of the bus electrode; and the third electrode is composed of a bus electrode and a transparent electrode located on one side of the bus electrode. Also, the transparent electrode of the first electrode is opposite to one transparent electrode of the second electrode so as to form one discharge center, and the transparent electrode of the third electrode is opposite to the other transparent electrode of the second electrode so as to form the other discharge center.

According to the objects of the present invention, a PDP of the present invention comprises: a first substrate and a second substrate; a plurality of address electrodes located between the first substrate and the second substrate; a plurality of emitting rows located between the first substrate and the address electrodes, wherein each of the emitting rows comprises a first electrode, a third electrode and at least one second electrode located between the first electrode and the third electrode; and a plurality of separation walls located between the emitting rows and the address electrodes, wherein the separation walls are arranged alternatively with the address electrodes, so as to divide the emitting rows into a plurality of emitting cells, each emitting cell having a first discharge center located between the first electrode and the second electrode, and a second discharge center located between the second electrode and the third electrode.

In a preferred embodiment of the present invention, the electrode parts can be varied. For example, the first electrode can be optionally connected to the same signal-supplying device with the third electrode, and consequently the first electrode and the third electrode become branches of the same electrode. Meanwhile, the first electrode and the third electrode can be optionally used as scan electrodes, and the second electrode can be optionally used as a common electrode; or the first electrode and the third electrode can be optionally used as common electrodes, and the second electrode can be optionally used as a scan electrode.

Further, the bus electrodes and the transparent electrodes can be designed alternatively. For example, the aforementioned bus electrode can be optionally formed as in the shape of comb, having a main line and several branch lines. The transparent electrode can be coupled to the branches lines of the bus electrode, and can be designed in the shape of long line or frame stripe, or has a certain distance away from the main line of the bus electrode. Further, a hollow space may exist in the middle of the bus electrode of the second electrode, such as a hollow space which is long-fine-stripe shape and is parallel to the bus electrode of the second electrode.

On the other hand, the present invention can also make the distance between the transparent electrode of the first electrode and the transparent electrode of the second electrode different from that between the transparent electrode of the second electrode and the transparent electrode of the third electrode, thereby making the discharge gaps of two discharge centers different. Also, a black-line structure can be inserted between two emitting rows for blocking light.

The application of the front panel structure according to the present invention can provide the advantages of providing uniform discharge, promoting discharge efficiency, increasing luminance intensity, prolonging the operation life of the product, broadening operational voltage range, balancing firing voltage and efficiency, and distributing peak current, etc.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

In the following, several preferred embodiments are used for explaining the PDP front panel structure of the present invention. In order to make the description regarding the present invention more complete and in detail, please refer to the following description about the preferred embodiments accompanying with FIGS. 2 to 7.

The present invention provides a front panel structure having dual discharge centers, forming two discharge centers in each of the emitting cells, wherein a bus electrode of a common electrode is located in the center of an emitting cell, and transparent electrodes are formed on both sides of the bus electrode of the common electrode. A bus electrode of a scan electrode is located on both top and bottom sides of the emitting center, and can be controlled by the same signal-supplying device or different signal-supplying devices, and a transparent electrode is formed on the inner side of the bus electrode of the scan electrode, i.e. the location near the center of the emitting cell, thereby forming two discharge centers in the same emitting cell. The positions of the above-described common and scan electrodes can be swapped, i.e. the scan electrode is located in the center of the emitting cell; and the common electrodes are located on both top and bottom sides thereof.

Figure 2:
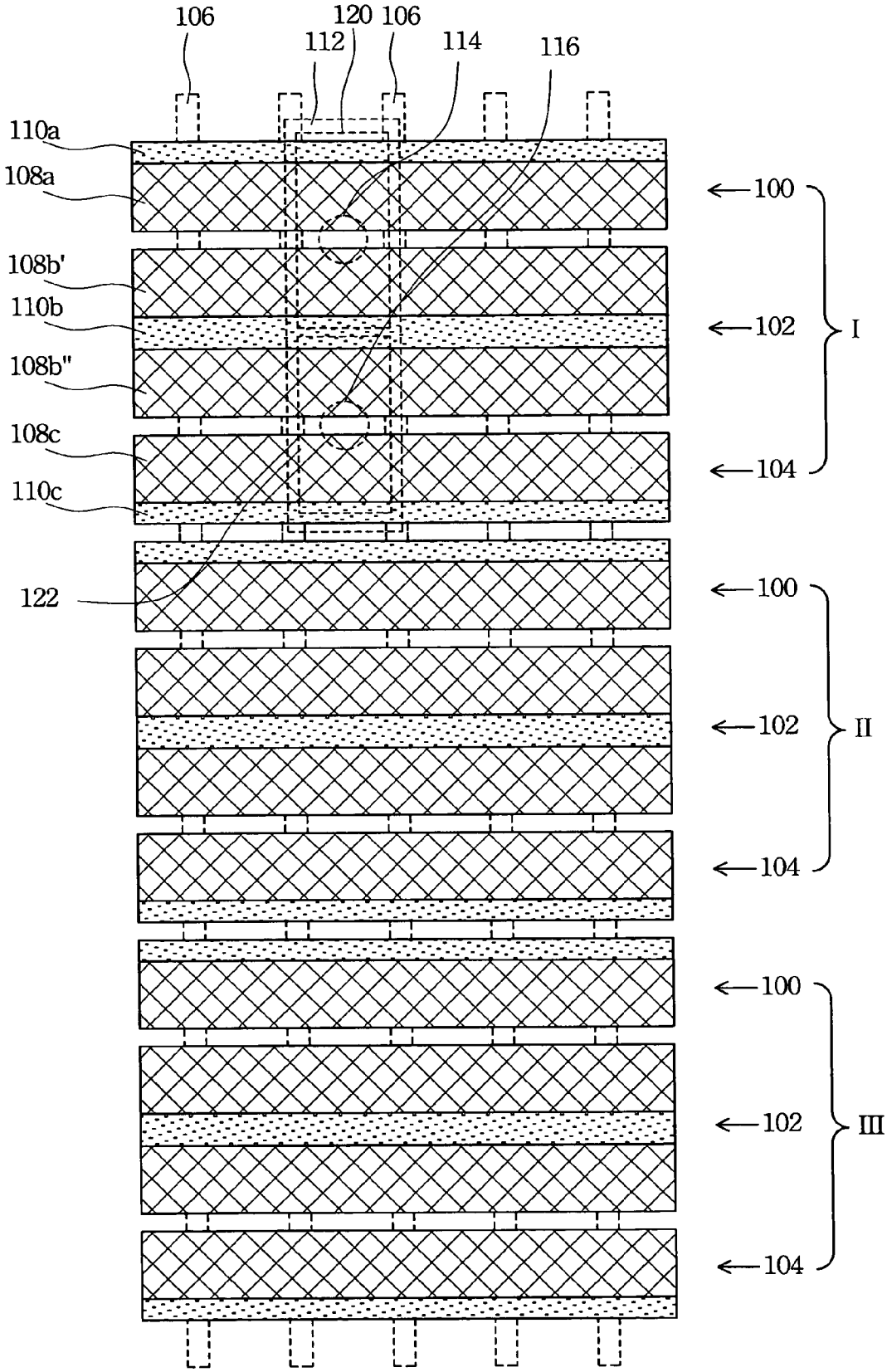
FIG. 2 is a schematic top view showing the front panel structure of dual discharge centers, according to the present invention.

FIG. 2 is a schematic top view showing the front panel structure of dual discharge centers, according to the present invention. Referring to FIG. 2 the front panel structure are mostly formed on a top substrate located on one side of a display image, including electrodes 100, 102 and 104 which are spaced apart from one another with a certain distance., wherein the electrode 100 and the electrode 104 belong to the same type of electrode. For example, if the electrode 100 and the electrode 104 are scan electrodes, the electrode 102 is a common electrode; and if the electrode 100 and the electrode 104 are common electrodes, then the electrode 102 is a scan electrode.

Regardless of the electrode 100, the electrode 102 and the electrode 104, they are all composed of transparent electrodes and bus electrodes mutually connected, wherein the transparent electrodes are made of transparent electrode material, such as ITO, used for allowing visible light to pass through; and the bus electrodes are used for increasing the electrical conductivity of the electrodes, and can be made of the material such as aluminum, cobalt, silver, molybdenum, chromium, tantalum, tungsten, iron, copper or the alloys thereof. Generally speaking, the bus electrode is opaque.

For example, the electrode 100 is composed a long-striped-shaped transparent electrode 108*a* and a long-striped-shaped bus electrode 110*a*; and the electrode 102 is composed a long-striped-shaped transparent electrode 108*b*', a long-striped-shaped transparent electrode 108*b*" and a long-striped-shaped bus electrode 110*b*, wherein the transparent electrode 108*b*' and the transparent electrode 108" are respectively located on both top and bottom sides of the bus electrode 110*b*, and the transparent electrode 108*b*' is located on the same side with the transparent electrode 108*a* with no contact. The electrode 104 is also composed a long-striped-shaped transparent electrode 108*c* and a long-striped-shaped bus electrode 110*c*, wherein the transparent electrode 108*c* is located on the same side with the transparent electrode 108*b*" with no contact. Hence, such as shown in FIG. 2, sequentially from the top to the bottom, the repetition structure is composed of: the bus electrode 110*a*, the transparent electrode 108*a*, the transparent electrode 108*b*', the bus electrode 110*b*, the transparent electrode 108*b*", the transparent electrode 108*c* and the bus electrode 110*c*.

An emitting row is composed of the electrode 100, the electrode 102 and the electrode 104, such as row I, row II and row III. Each of the emitting rows is also divided into several emitting cells 112 by separation walls 106 fabricated on the structure of the bottom substrate, wherein the bus electrode 110*a*, the bus electrode 110*b* and the bus electrode 110*c* cross over each of the emitting cells 112 arranged in a row, and are connected to a signal-supplying device (not shown) for controlling gas discharge of a specific emitting cell. Generally speaking, the signal-supplying device of the scan electrode is different from that of the common electrode, and the bus electrodes 110*a* and 110*c* belonging to the same type of electrode in the aforementioned structure can be optionally connected to the same signal-supplying device. The choice of being connected to the same signal-supplying device means that the electrode 100 and the electrode 104 are branches of the same electrode, and are controlled by the same signal-supplying device.

The emitting cell 112 thus has two discharge centers, which respectively are a discharge center 114 located between the transparent electrode 108*a* and the transparent electrode 108*b*'; and a discharge center 116 located between the transparent electrode 108*b*" and the transparent electrode 108*c*, such as the dashed circular areas shown in FIG. 2.

Figure 3:
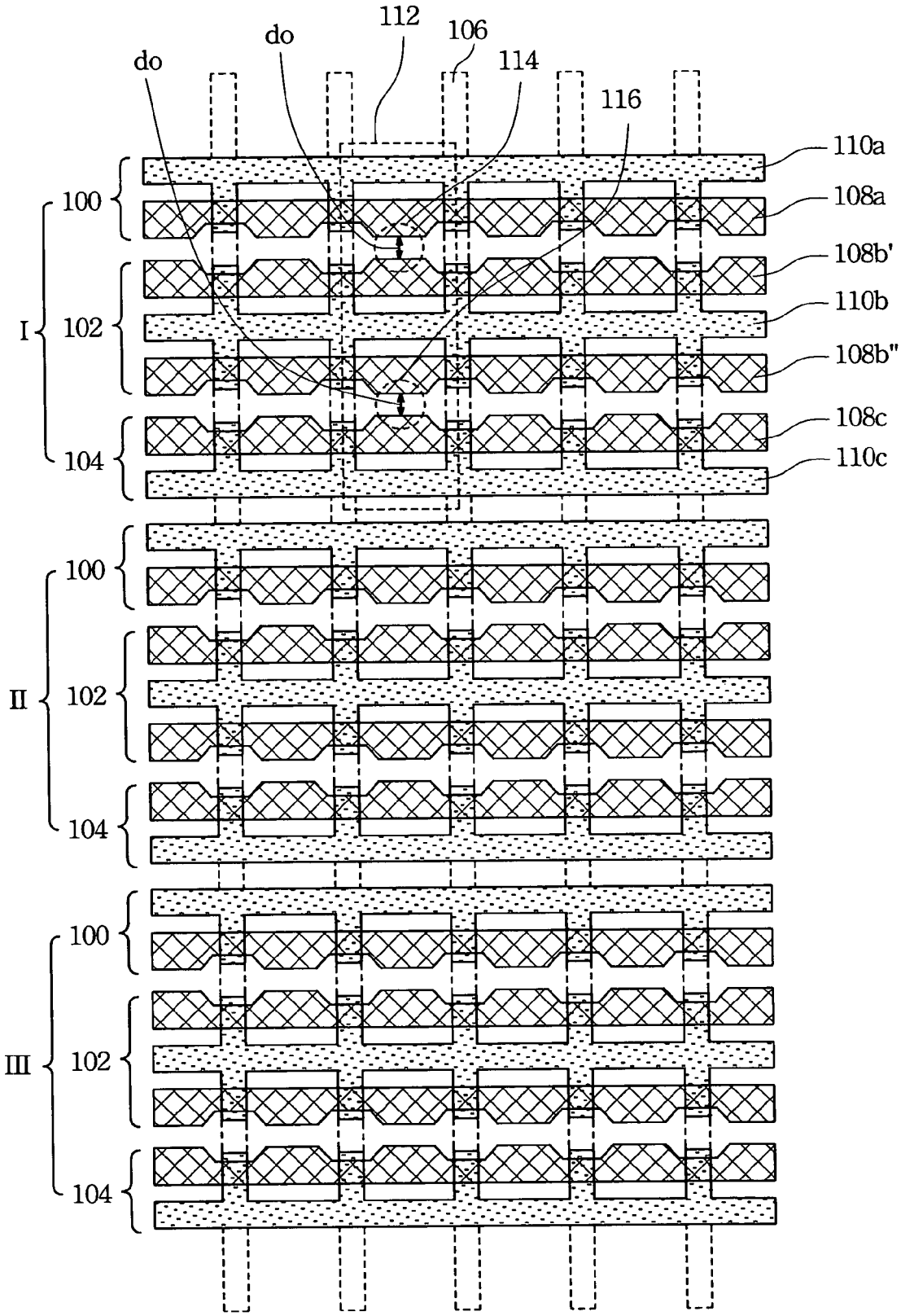
FIG. 3 is a schematic top view showing the front panel structure of a PDP, according to a preferred embodiment of the present invention.
Figure 4:
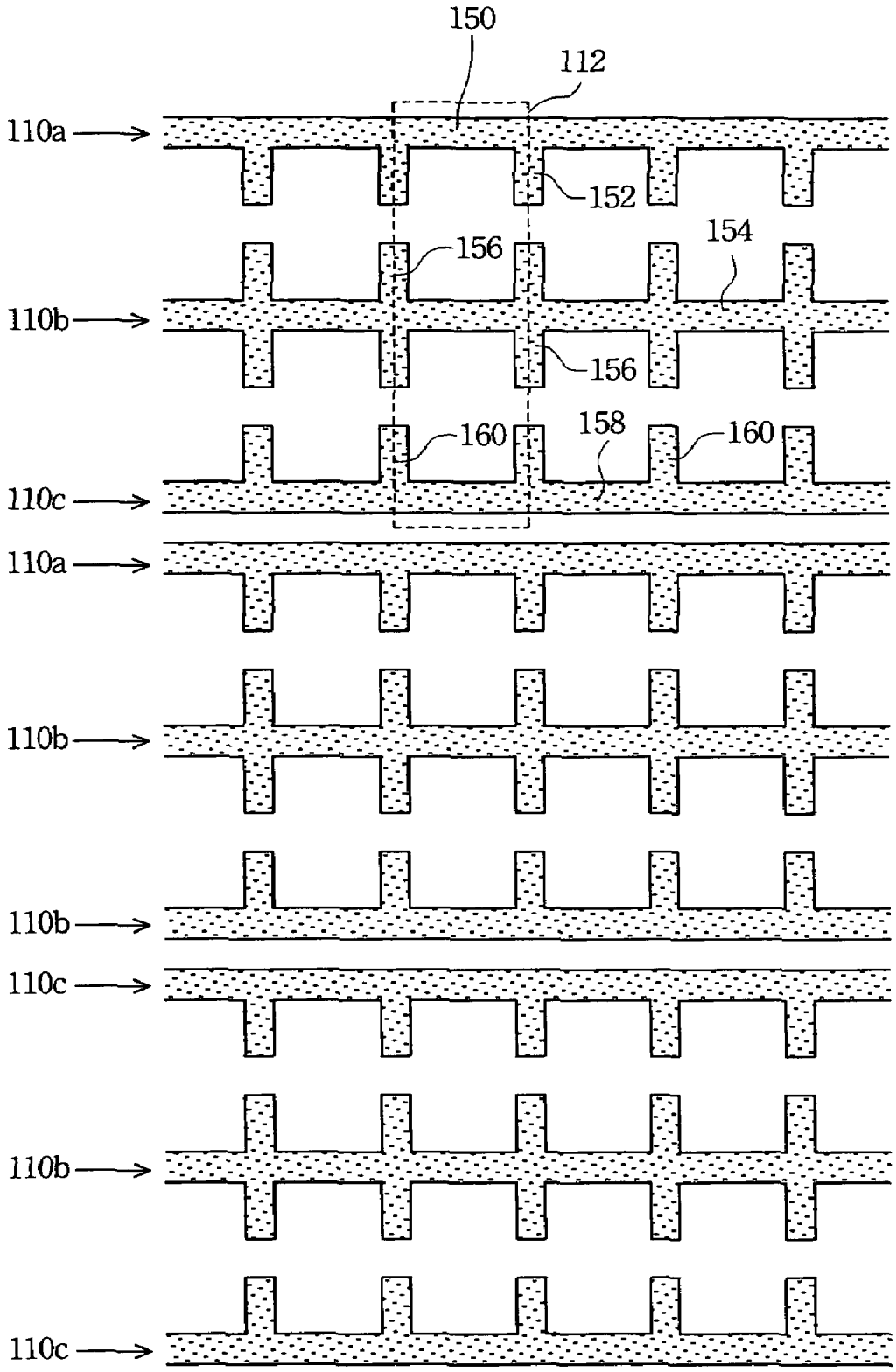
FIG. 4 is a schematic top view showing a bus electrode of the electrode shown in FIG. 3.

Except that each of the emitting rows can generally be the direct connections of the horizontal straight bus electrodes and the transparent electrodes (such as shown in FIG. 2), each of the bus electrodes can be also designed in the shape of comb, wherein the extended branch lines of the comb-shaped bus electrodes can be used for connecting to the transparent electrodes, such as shown in FIG. 3. In order to make the description regarding the bus electrodes clearer, the bus electrodes are depicted alone in FIG. 4. Referring to FIG. 4, a comb-shaped bus electrode 110*a* comprises a main line 150 which crosses over each of the emitting cells 112 arranged in a row and is connected to a signal-supplying device (not shown); and several branch lines 152 which are extended from one side of the main line 150 and are located between the emitting cells 112. A comb-shaped bus electrode 110*b* comprises a main line 154 which crosses over each of the emitting cells 112 arranged in a row and is connected to a signal-supplying device (not shown); and several branch lines 156 which are extended from both top and bottom sides of the main line 154 and are located between the emitting cells 112. A comb-shaped bus electrode 110*c* comprises a main line 158 which crosses over each of the emitting cells 112 arranged in a row and is connected to a signal-supplying device (not shown); and several branch lines 160 which are extended from one side of the main line 158 and are located between the emitting cells 112. The aforementioned number of branch lines matching the main line can be changed arbitrarily, and the present invention is not limited thereto.

Thereafter, referring to FIG. 3 again, when the comb-shaped front panel structures shown in FIG. 4 are applied to the front panel structure of dual discharge centers, generally, the branch lines of the bus electrode 110*a*, those of the bus electrode 110*b* and those of the bus electrode 110*c* (such as branch lines 152, 156 and 160 shown in FIG. 4) are aligned to the separation walls 106. Hence, the opaque branch lines of the bus electrodes do not block the light emitted from the emitting cells 112. Further, the transparent electrodes of each electrode can be merely coupled to the branch lines of the comb-shaped bus electrode. For example, the transparent electrode 108*a* of the electrode 100 can be incompletely connected to the bus electrode 110*a* thereof, and is merely coupled to the branch line (such as the branch line 152 shown in FIG. 4) of the bus electrode 110*a*. Hence, in comparison with the structure shown in FIG. 2, the area of the transparent electrode 108*a* is reduced a lot. Similarly, the areas of the transparent areas 108*b*' and 108*b*" of the electrode 102, and the area of the transparent electrode 108*c* of the electrode 104 are also reduced a lot accordingly. Since a discharge gap can be defined as the distance between two transparent electrodes, thus in this preferred embodiment, the discharge gap of the discharge center 114 and that of the discharge center 116 both are $d_0$. The shapes of the transparent electrodes matching the comb-typed bus electrodes are not merely limited to the fine-line shape having arch edges, and the other shapes such as a long-stripe shape can also be adopted by making modification in accordance with the actual needs, so that the present invention is not limited thereto.

Figure 5:
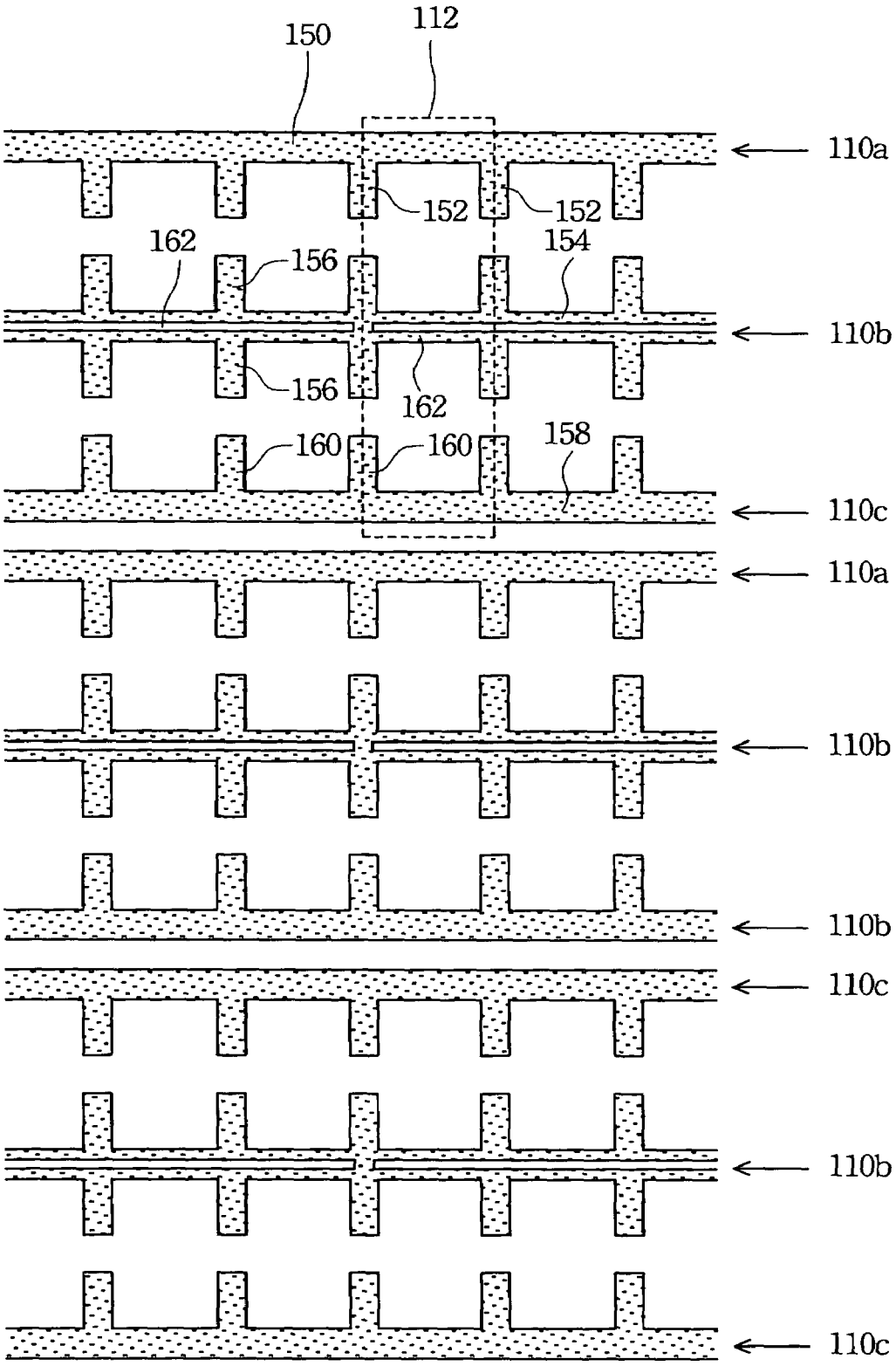
FIG. 5 is a schematic top view showing a bus electrode of the other electrode shown, according to the preferred embodiment of the present invention.

In the front panel structure of the present invention, the bus electrode located in the center of each emitting row can further have a hollow space, such as shown in FIG. 5. Referring to FIG. 5, the bus electrode 110*b* penetrates the center of the emitting cell 112, and the main line 154 thereof is wider than that shown in FIG. 4, and several hollow spaces 162 of long-fine-stripe shape parallel to the main line 154 exist therein, wherein the shapes of the hollow spaces 162 can be changed in accordance with the actual needs, and the relative position of the hollow space in the emitting cell 112 or in the front panel structure is not limited and can be moved optionally, so that the present invention is not limited thereto. Further, the hollow space 162 is not necessarily limited to being used together with the bus electrode 110*b* having the main line 164 and the branch lines 156, but also can be used together with the long-stripe-shaped bus electrode 110*b* as shown in FIG. 2, so that the present invention is not limited thereto.

Figure 6:
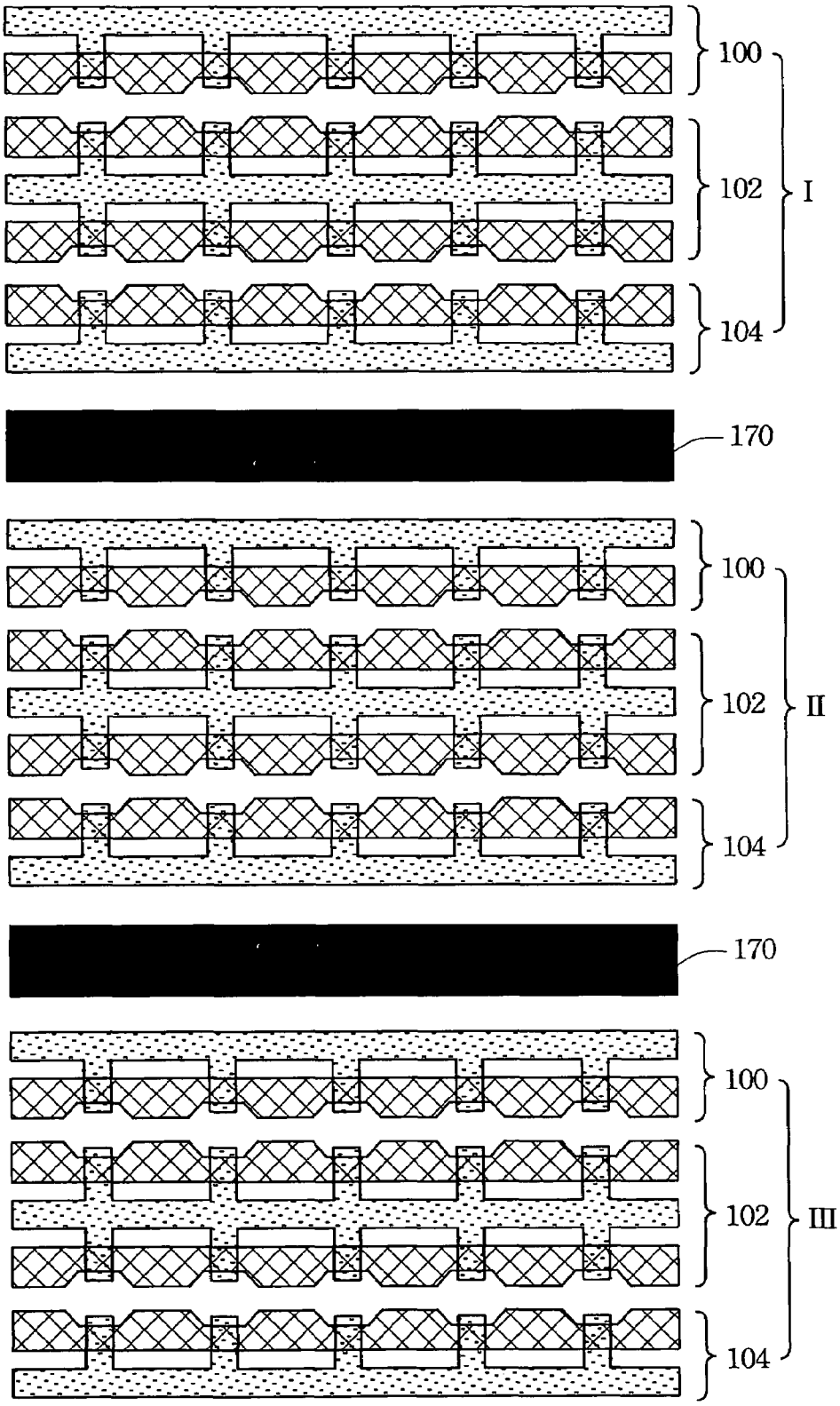
FIG. 6 is a schematic top view showing the front panel structure of a PDP, according to another preferred embodiment of the present invention.

In the structure shown in FIG. 2 and FIG. 3 of the present invention, there is no black-line sure existing between the emitting rows. However, in a preferred embodiment of the present invention, black-line structures can be inserted between the emitting rows, such as shown in FIG. 6. Referring to FIG. 6, an emitting row I and an emitting row II are divided by a black-line structure 170, so are the emitting row II and an emitting row III, and thus the light-blocking effect between the emitting rows is even better.

Figure 7:
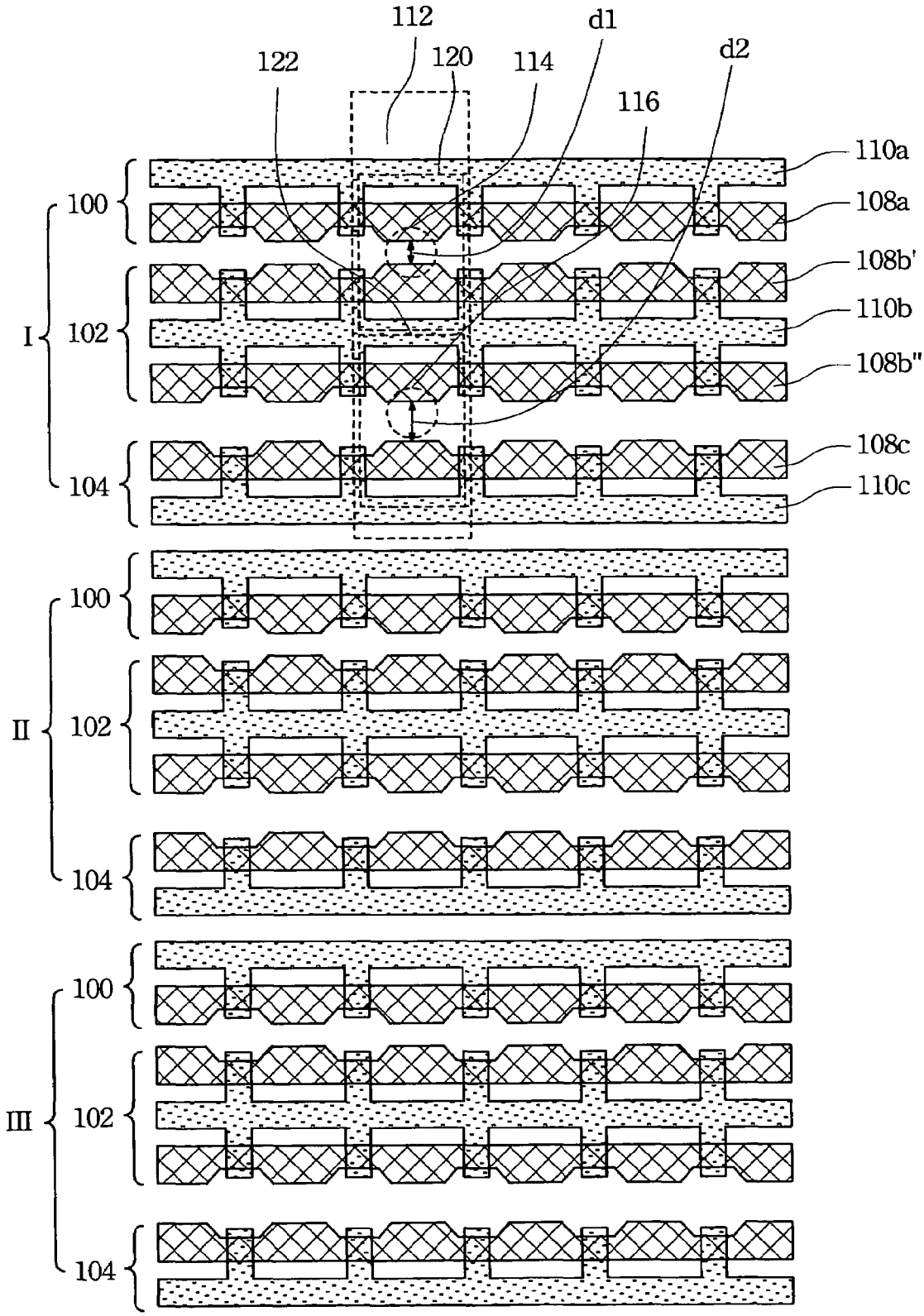
FIG. 7 is a schematic top view showing the front panel structure of a PDP, according to another preferred embodiment of the present invention.

Further, the present invention can make some amendment on the discharge gap, so as to make those two discharge centers of the discharge cell different, such as shown in FIG. 7. Referring to FIG. 7, under the condition without changing the original width of the emitting row, the entire electrode 102 can be moved upwards from the original position, so as to shorten the distance between the electrode 100 and the electrode 102, and increase the distance between the electrode 102 and the electrode 104. Therefore, in this front panel structure, the discharge gap of the discharge center 114 is $d_1$, and the discharge gap of the discharge center 116 is $d_2$, wherein $d_2>d_1$. Alternatively, under the condition without changing the original width of the emitting row and the original positions of the bus electrodes, the transparent electrodes of the electrodes can be moved so as to change the widths of the discharge gaps. For example, the transparent electrode 108*b*' is moved towards the transparent electrode 108*a*, and the transparent electrode 108*b*" is moved towards the transparent electrode 108*c*. The aforementioned methods for changing the discharge gaps are merely stated as examples for explanation, and the present invention is not limited thereto.

Further, the size and proportionality of the aforementioned front panel structure, such as the widths of the electrodes 102, 100 and 104; the discharge gaps; the distance between the transparent electrode and the bus electrode; and the distance between the emitting rows, etc., all can be changed in accordance with the product requirements, and thus the present invention is not limited thereto.

Figure 1:
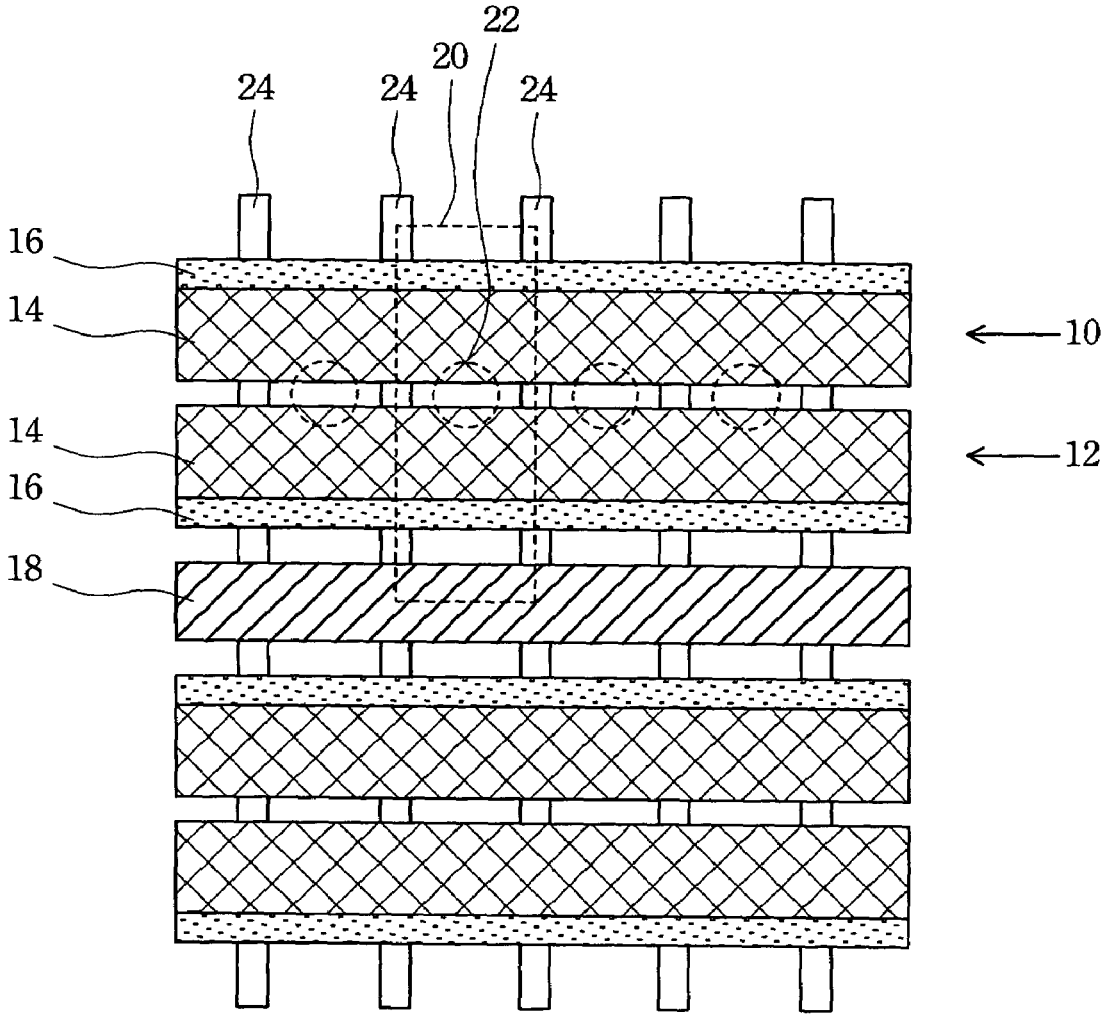
Fig. 1 (PRIOR ART)
FIG. 1 is a schematic top view showing the front panel structure of a general PDP.
Figure 8:
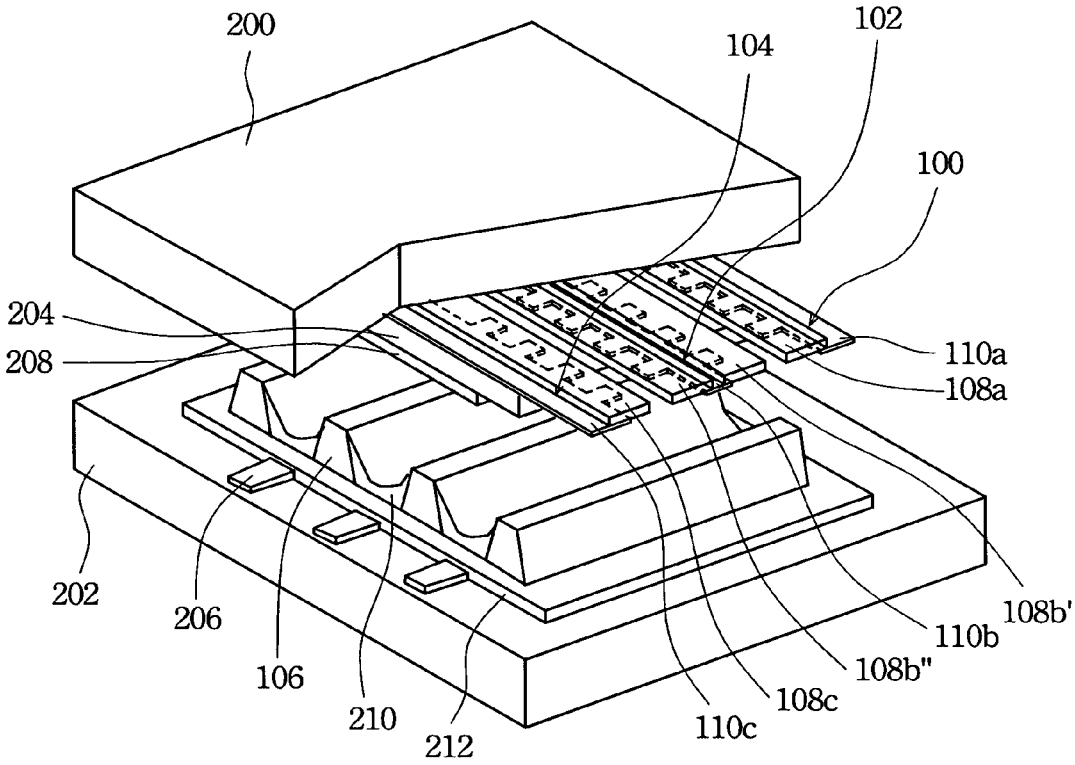
FIG. 8 is a 3-D schematic perspective diagram showing a PDP having a front panel structure of the present invention.

FIG. 8 is a 3-D schematic perspective diagram showing a PDP having a front panel structure of the present invention. Referring to FIG. 8, a PDP comprises a top substrate 200 and a bottom substrate 202. A plurality of address electrodes 206 arranged in parallel are located on the bottom substrate 202, and a dielectric layer 212 covers the address electrodes 206. A plurality of separation walls 106 arranged in parallel are formed on the dielectric layer 212, and are located between the address electrodes 206 and arranged alternatively with the address electrodes 206. Certainly, the present invention is not limited to the stripe-shaped separation walls 106 shown in FIG. 8, and can be the separation wall structures of various shapes. There is a color phosphor layer 210 between the separation walls 106. The inner side of the top substrate 200, i.e. the side in the same direction with the bottom substrate, has the electrode 100, the electrode 102 and the electrode 104, wherein the electrode 100 is composed of the bus electrode 110*a* and the transparent electrode 108*a*; the electrode 102 is composed of the bus electrode 110*b*, the transparent electrode 108*b*' and the transparent electrode 108*b*"; and the electrode 104 is composed of the bus electrode 110*c* and the transparent electrode 108*c*, wherein the transparent electrode 108*a* is opposite to the transparent electrode 108*b*'; and the transparent electrode 108*c* is opposite to the transparent electrode 108*b*". The aforementioned electrodes 100, 102 and 104 form an emitting row. Certainly, the present invention is not limited to having only one emitting row, but can have several emitting rows. Further, a dielectric layer 204 and a protective layer 208 are formed on the top substrate 100 to cover the electrodes 100, 102 and 104. The numerals shown in FIG. 8 and those shown in FIG. 1 are the same, representing identical elements, so that FIG. 1 and FIG. 8 can be used as cross-references.

Figure 9:
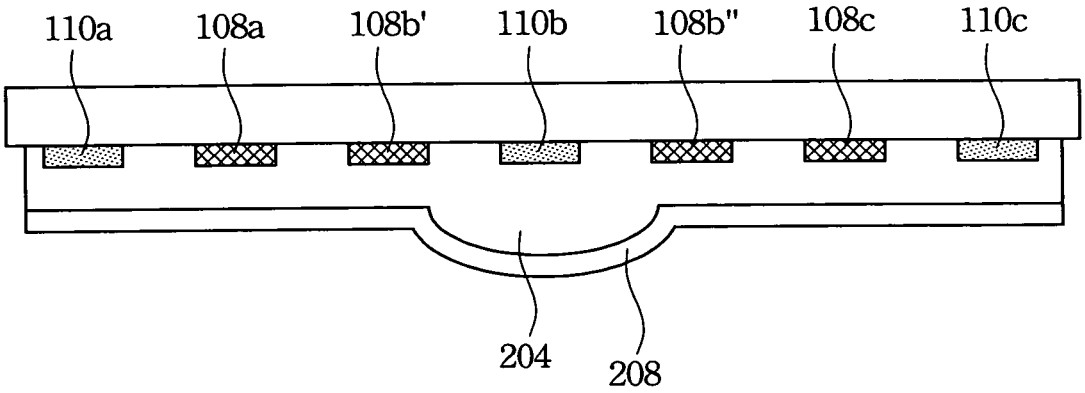
FIG. 9 is a cross-section showing the front panel structure of a PDP according to another preferred embodiment of the present invention.
Figure 10:
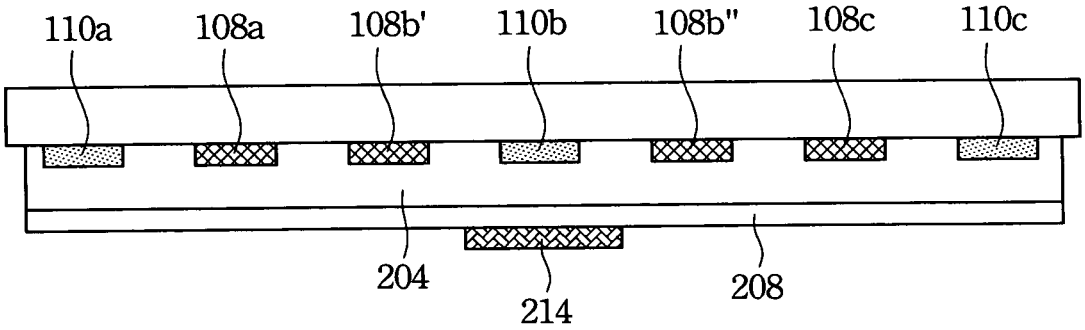
FIG. 10 is a cross-section showing the front panel structure of a PDP according to still another preferred embodiment of the present invention.

FIGS. 9 and 10 are cross-sections showing the front panel structure of a PDP of the preset invention, wherein the dielectric layer 204 and protective layer 208 are formed on the front panel structure. As described above, there is discharge unstable when optionally uses the second electrode as a scan electrode. Therefore, the dielectric layer 204 under the bus electrode 110*b* of the electrode 102 can make thicker as shown in FIG. 9, or a discharge deactivation film 214 can be formed on the protective layer 208 as shown in FIG. 10, to avoid the discharge unstable.

It can be known from the preferred embodiments of the present invention that the front panel structure of the present invention is to divide one original emitting cell into two sub-emitting cells, such as a sub-emitting cell 120 and a sub-emitting cell 122 shown in FIG. 2. Thus, the distance of UV light diffused from the discharge center of each sub-emitting cell to the edge of the emitting cell is shorter than that of UV light diffused from the conventional discharge center 22 shown in FIG. 1 to the edge of the emitting cell, thus preventing the loss of the UV light diffused from the discharge center. Since the present invention can reduce the loss of UV light and make the distribution thereof more uniform, the luminance intensity of the phosphors can be effectively enhanced.

Moreover, while the front panel structure of the present invention is under gas discharge, the discharge area is allocated on two areas of the emitting cell, so that the discharge is more uniform so as to prevent the shortcoming of being overly emphasized on the central position of the emitting cell and causing the damage of the conventional panel, thus prolonging the operation life of the product.

In the front panel structure of the present invention, since the dual discharge centers and the comb-shaped electrodes can provide more uniform electric field, even more uniformly distributed light can be obtained accordingly, and since the comb-shaped electrode is much closer to the discharge center than the conventional bus electrode, the operational driving voltage range of the PDP is much broader, thus benefiting for the input of high-speed signals during the phase of driving operation. Further, when the comb-shaped electrode is made of anti-reflection material, the displaying contrast of the PDP can be further enhanced; when the area used by the transparent electrode is less, the power consumption can be reduced while maintaining discharge. Further, if the bus electrode penetrating through the center of the emitting cell has a hollow space, then the allowed current value is increased and the light-blocking area is reduced.

In the front panel structure of the dual discharge centers according to the present invention, when the sub-emitting centers of one identical emitting center are designed to respectively having different discharge gaps, there are advantages of balancing firing voltage and increasing luminance efficiency, and also due to different discharge time of the two sub-emitting centers, the peak current during discharge can be well distributed.

Speaking in more detail, the luminance efficiency and firing voltage are proportional to the discharge gap, i.e. the bigger the discharge gap is, the higher the firing voltage is and the better the luminance efficiency is. However, with too large firing voltage, the cost of driving is increased a lot because the driving method of higher voltage is needed. Therefore, referring FIG. 7, in the structure of the dual discharge centers having different discharge gaps according to the present invention, since the discharge gap $d_2$ is larger than the discharge gap $d_1$, a lower firing voltage can be used to drive the sub-emitting cell 120 having, and thus active particles are generated and diffused to the sub-emitting cell 122, so that the sub-emitting cell 122 can be driven even with the driving voltage less than the original firing voltage. Meanwhile, the sub-emitting cell 122 can obtain better luminance efficiency, and the peak current can be distributed and lowered since the discharge of the sub-emitting cell 120 occurs earlier than that of the sub-emitting cell 122.

In the dual emitting centers of the present invention, except the aforementioned description of changing the discharge gaps to change the firing voltages of the two sub-emitting cells, the thickness of the electrical inductor can also be changed to change the firing voltages. For example, referring to FIG. 8, generally, during a writing period, the address electrode 206 and the scan electrode are controlled to perform a discharge step for enabling one certain emitting cell or sub-emitting cell to generate light, and then in a maintaining period, the scan electrode and the common electrode of the same emitting cell or sub-emitting cell are used to perform a discharge step for maintaining the luminance effect. Hence, assume that the electrode 100 and the electrode 104 are the scan electrodes, and the electrode 102 is the common electrode. In an emitting cell, if thickness of the dielectric layer 204 under the electrodes 100 and 104 used as the scan electrodes is changed, or the thickness of the dielectric layer 212 which corresponds to the electrode 100 and the electrode 104, and is located above the address electrode 206 is changed, then the firing voltage of the sub-emitting cell located on the position at which the electrode 100 crosses with the address electrode 206 is different from that of the sub-emitting cell located on the position at which the electrode 104 crosses with the address electrode 206.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A front panel structure of a plasma display panel (PDP), comprising a first electrode, comprising:

a first bus electrode; and a first transparent electrode, connected to one side of said first bus electrode;

a second electrode, comprising:

a second transparent electrode;

a second bus electrode; and a third transparent electrode, wherein said second transparent electrode and said third transparent electrode are connected to both top and bottom sides of said second bus electrode; and a third electrode, comprising:

a third bus electrode; and a fourth transparent electrode, connected to one side of said third bus electrode;

wherein said second electrode is located between said first electrode and said third electrode, and said first transparent electrode is opposite to said second transparent electrode, and said third transparent electrode is opposite to said fourth transparent electrode, the area between said first electrode and said second electrode forming a first discharge center, said the area between said second electrode and said third electrode forming a second discharge center.

2. The front panel structure according to claim 1, wherein said first electrode and said third electrode are connected to the same signal-supplying device.

3. The front panel structure according to claim 1, wherein said first electrode and said third electrode are scan electrodes, and said second electrode is a common electrode.

4. The front panel structure according to claim 1, wherein said first electrode and said third electrode are common electrodes, and said second electrode is a scan electrode.

5. The front panel structure according to claim 4, wherein a thicker dielectric layer is formed below said second bus electrode.

6. The front panel structure according to claim 4, wherein a discharge deactivation film is formed below a protective layer of said second bus electrode.

7. The front panel structure according to claim 1, wherein said first bus electrode is a comb shape, having a main line and a plurality of branch lines, and said plurality of branch lines and said first transparent electrode are on the same side.

8. The front panel structure according to claim 1, wherein said second bus electrode is a comb shape, having a main line and a plurality of branch lines, and said plurality of branch lines are located on both top and bottom sides of said main line.

9. The front panel structure according to claim 1, wherein said third bus electrode is a comb shape, having a main line and a plurality of branch lines, and said plurality of branch lines and said third transparent electrode are on the same side.

10. The front panel structure according to claim 1, wherein said second bus electrode has at least one hollow space.

11. The front panel structure according to claim 10, wherein said hollow space is a fine-long-stripe shape parallel to said second bus electrode.

12. The front panel structure according to claim 1, wherein there is a first distance between said first transparent electrode and said second transparent electrode, and there is a second distance between said third transparent electrode and said fourth transparent electrode, and said first distance is different from said second distance.

13. The front panel structure according to claim 1, wherein the thickness of a dielectric layer located below said first electrode, said second electrode and said third electrode are different, said dielectric layer located on one of a top substrate or a bottom substrate of the PDP.

14. A plasma display panel (PDP), comprising:

a first substrate and a second substrate;

a plurality of address electrodes, located between said first substrate and said second substrate;

a plurality of emitting rows, located between said first substrate and said plurality of address electrodes, each of said plurality of emitting rows comprising:

a first electrode, wherein said first electrode is at least composed of a first bus electrode and a first transparent electrode connected to one side of said first bus electrode;

at least one second electrode, wherein said second electrode is at least composed of a second bus electrode, and a second transparent electrode and a third transparent electrode which are connected to two opposite sides of said second bus electrode, and said first transparent electrode is opposite to said second transparent electrode; and a third electrode, wherein said second electrode is located between said first electrode and said third electrode, and said third electrode is at least composed of a third bus electrode and a fourth transparent electrode connected to said third bus electrode, wherein said third transparent electrode is opposite to said fourth transparent electrode; and a plurality of separation walls, located between said plurality of emitting rows and said plurality of address electrodes, used for dividing said plurality of emitting rows into a plurality of emitting cells, wherein each of said plurality of emitting cells has a first discharge center and a second discharge center, and the first discharge center is located between said first electrode and said second electrode, and the second discharge center is located between said second electrode and said third electrode.

15. The PDP of claim 14, further comprising a plurality of phosphors, located between said plurality of separation walls.

16. The PDP of claim 14, further comprising at least one black-line structure, located between said plurality of emitting rows.

17. The PDP of claim 14, wherein said first electrode and said third electrode are connected to the same signal-supplying device.

18. The PDP of claim 14, wherein said first electrode and said third electrode are scan electrodes, and said second electrode is a common electrode.

19. The PDP of claim 14, wherein the thickness of a first dielectric layer located below said first electrode is different from the thickness of a second dielectric layer located below said third electrode.

20. The PDP of claim 14, wherein said first electrode and said third electrode are common electrodes, and said second electrode is a scan electrode.

21. The PDP of claim 14, wherein the discharge gap of said first discharge center is different from the discharge gap of said second discharge center.

22. The PDP of claim 14, wherein said first bus electrode is a comb shape, having a main line and a plurality of branch lines, and said first transparent electrode is connected to said plurality of branch lines.

23. The PDP of claim 14, wherein said second bus electrode is a comb shape, having a main line and a plurality of branch lines, and said second transparent electrode and said third transparent electrode are connected to said plurality of branch lines.

24. The PDP of claim 14, wherein said third bus electrode is a comb shape, having a main line and a plurality of branch lines, and said fourth transparent electrode is connected to said plurality of branch lines.

25. The PDP of claim 14, wherein said second bus electrode has at least one hollow space.

26. The PDP of claim 14, wherein there is a first distance between said first transparent electrode and said second transparent electrode, and there is a second distance between said third transparent electrode and said fourth transparent electrode, and said first distance is different from said second distance.

* * * * *